US008330679B2

(12) United States Patent
Miyazawa

(10) Patent No.: US 8,330,679 B2
(45) Date of Patent: Dec. 11, 2012

(54) ELECTRONIC CIRCUIT, ELECTRO-OPTICAL DEVICE, ELECTRONIC DEVICE AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 980 days.

(21) Appl. No.: 12/153,235

(22) Filed: May 15, 2008

(65) Prior Publication Data

US 2008/0297441 A1 Dec. 4, 2008

Related U.S. Application Data

(63) Continuation of application No. 11/103,481, filed on Apr. 12, 2005, now abandoned.

(60) Provisional application No. 60/572,778, filed on May 21, 2004.

(51) Int. Cl.
*G09G 3/30* (2006.01)

(52) U.S. Cl. ..... 345/76; 345/77; 315/169.3

(58) Field of Classification Search ..... 345/76–80, 345/82–84; 315/169.3
See application file for complete search history.

(56) References Cited

U.S. PATENT DOCUMENTS

| | | | | |
|---|---|---|---|---|
| 6,777,888 | B2 * | 8/2004 | Kondo | 315/169.3 |
| 6,798,148 | B2 | 9/2004 | Inukai | |
| 6,841,948 | B2 * | 1/2005 | Yoshida | 315/169.3 |
| 6,989,826 | B2 | 1/2006 | Kasai | |
| 7,167,169 | B2 * | 1/2007 | Libsch et al. | 345/211 |
| 7,170,094 | B2 * | 1/2007 | Yamazaki et al. | 345/102 |
| 7,176,857 | B2 * | 2/2007 | Osame et al. | 345/76 |
| 7,193,589 | B2 * | 3/2007 | Yoshida et al. | 345/76 |
| 7,209,101 | B2 * | 4/2007 | Abe | 345/76 |
| 7,417,607 | B2 * | 8/2008 | Miyazawa | 345/76 |
| 7,466,311 | B2 | 12/2008 | Kasai | |
| 2002/0135309 | A1 | 9/2002 | Okuda | |
| 2003/0016190 | A1 | 1/2003 | Kondo | |
| 2003/0098829 | A1 | 5/2003 | Chen et al. | |
| 2003/0107565 | A1 * | 6/2003 | Libsch et al. | 345/211 |
| 2004/0056605 | A1 * | 3/2004 | Yoshida | 315/169.3 |

(Continued)

FOREIGN PATENT DOCUMENTS

JP A-2003-114645 4/2003

(Continued)

OTHER PUBLICATIONS

Choi et al., "A Self-Compensated Voltage Programming Pixel Structure for Active-Matrix Organic Light Emitting Diodes," IDW 2003 Proceedings of the 10th International Display Workshops, The Society for Information Display, Dec. 3, 2003, pp. 535-538.

*Primary Examiner* — Jason Mandeville
(74) *Attorney, Agent, or Firm* — Oliff & Berridge, PLC

(57) ABSTRACT

Aspects of the invention can provide an electronic circuit that can include a first transistor having a first and second terminal between which a first channel region can be formed, and a second transistor having a third and fourth terminal between which a second channel region can be formed. In the electronic circuit, a gate voltage of the first transistor can be based on a programming current flowing from the first terminal to the second terminal during a first step, a reproducing current flowing from the second terminal to the first terminal during a second step, and a current level of the reproducing current corresponding to the gate voltage determined during the first step.

20 Claims, 5 Drawing Sheets

U.S. PATENT DOCUMENTS

| | | | | |
|---|---|---|---|---|
| 2004/0174354 | A1 | 9/2004 | Ono et al. | |
| 2005/0030304 | A1 | 2/2005 | Inukai | |
| 2005/0093804 | A1 * | 5/2005 | Yamazaki et al. | 345/92 |
| 2005/0206590 | A1 | 9/2005 | Sasaki et al. | |
| 2006/0066527 | A1 | 3/2006 | Chou | |
| 2006/0208972 | A1 | 9/2006 | Kasai et al. | |

FOREIGN PATENT DOCUMENTS

| | | | |
|---|---|---|---|
| JP | A-2003-263129 | | 9/2003 |
| JP | A-2003-271095 | | 9/2003 |
| JP | A-2003-255896 | | 10/2003 |
| WO | WO 02/054373 | A2 | 7/2002 |
| WO | WO 02/071379 | A2 | 9/2002 |

* cited by examiner

ELECTRONIC CIRCUIT, ELECTRO-OPTICAL DEVICE, ELECTRONIC DEVICE AND ELECTRONIC APPARATUS

This is a Continuation of application Ser. No. 11/103,481 filed on Apr. 12, 2005. The disclosure of the prior application is hereby incorporated by reference herein its entirety.

This is a nonprovisional application claims the benefit of U.S. Provisional Application No. 60/572,778, filed May 21, 2004.

BACKGROUND

The present invention relates to an electronic circuit that can be applied to a pixel circuit and a sensing circuit, and electronic device such as an electro-optical device and a detection device, and electronic apparatus.

Recently, interest has arisen for electro-optical device having an electro-optical element such as organic EL element since it excels in low power consumption, wide view angle, and higher contrast ratio. Transistor is often used for driving such a electro-optical element. Variation or change of characteristic of transistor has a significant affect on performance of electro-optical element. Compensation or reduction of the variation or change is an important subject to improve performance of an electronic device.

SUMMARY

An electronic circuit related to the invention can include a first transistor having a first terminal, a second terminal, a first channel region formed between the first terminal and the second terminal, and a second transistor having a third terminal, a fourth terminal, a second terminal formed between the third terminal and the fourth terminal. A gate voltage of the first transistor can be determined according to a programming current flowing from the first terminal to the second terminal during a first step. A reproducing current flows from the second terminal to the first terminal, and a current level of the reproducing current may correspond to the gate voltage determined according to the programming current. In the electronic circuit, the programming current may flow from the third terminal to the second terminal through the fourth terminal and the first terminal.

An electronic circuit related to the invention can include a first transistor having a first terminal, a second terminal, a first channel region formed between the first terminal and the second terminal, a second transistor having a third terminal, a fourth terminal, a second channel region formed between the third terminal and the fourth terminal, and a third transistor having a fifth terminal, a sixth terminal, a third channel region formed between the fifth terminal and the sixth terminal. A gate voltage of the first transistor can be determined according to a programming current flowing from the fifth terminal to the sixth terminal during a first step. The current level of a reproducing current flowing the second terminal to the first terminal during a second step may correspond to the gate voltage of the first transistor determined according to the programming current. A potential of the fifth terminal of the electronic circuit may be equal to or greater than the potential of the sixth terminal during the first step.

A gate of the third transistor of the second electronic circuit may be coupled to one of the fifth terminal and the sixth terminal.

The electronic circuit may further include a capacitor having a first electrode and a second electrode. The first electrode can be coupled to the gate of the first transistor. The second electrode of the capacitor may be coupled to one of the first terminal and the second terminal.

A potential of the first terminal may be equal to or greater than a potential of the second terminal during at least a period other than the second step.

A potential of the sixth terminal may be equal to or greater than a potential of the fifth terminal during the second step.

An electronic circuit related to the invention can include a first transistor having a first terminal, a second terminal, a first channel region formed between the first terminal and the second terminal, a second transistor having a third terminal, a fourth terminal, a second channel region formed between the third terminal and the fourth terminal, and a third transistor having a fifth terminal, a sixth terminal, a third channel region formed between the fifth terminal and the sixth terminal. A gate voltage of the first transistor can be determined according to a programming current flowing from the fifth terminal to the sixth terminal during a first step, a reverse biasing current flows from the first terminal to the second terminal during at least a part of the first step for suppression of change of threshold voltage of the first transistor, a reproducing current flows from the second terminal to the first terminal during a second step, the current level of the reproducing current corresponds to the gate voltage determined according to the programming current, and the potential of the first terminal being equal to or less than the potential of the second terminal during the second step. The electronic circuits can be used as an electronic circuit applicable to electronic devices, such as a electro-optical device and an detection device.

An electro-optical device of the invention can include a plurality of data lines, a plurality of scanning lines, a plurality of voltage supply lines, a plurality of pixel circuits. Each of the plurality of pixel circuits can further include a driving transistor having a first terminal, a second terminal, a channel region formed between the first terminal and the second terminal, an electro-optical element, a switching transistor that is controlled by a scanning signal supplied from one of the plurality of scanning lines. A gate voltage of the driving transistor is based on a data current flowing between one of the plurality of data lines and one of the plurality of voltage supply lines during a first step. At least one of a driving voltage and a driving current is supplied to the electro-optical element. A voltage level of the driving voltage and a current level of the driving current may correspond to the gate voltage. A reverse biasing current flowing from the first terminal to the second terminal during at least a portion of the first step, and a forward biasing current flows from the second terminal to the first terminal during at least a portion of a second step. Additionally, each of the plurality of pixel circuits can include a compensating transistor that compensates for a characteristic of the driving transistor, and the data current flows through the compensating transistor.

An electro-optical device of the invention can include a plurality of data lines, a plurality of scanning lines, a plurality of voltage supply lines, a plurality of pixel circuits. Each of the plurality of pixel circuits can further include a driving transistor having a first terminal, a second terminal, a channel region formed between the first terminal and the second terminal, an electro-optical element, a switching transistor that is controlled by a scanning signal supplied from one of the plurality of scanning lines. A gate voltage is based on a data current flowing between one of the plurality of data lines and one of the plurality of voltage supply lines during a first step. A driving current is supplied to the electro-optical element during a second step. A current level of the driving current may correspond to the gate voltage. The driving current flows from the second terminal to the first terminal, and the data current flows from the first terminal to the second terminal during the first step.

An electronic device of the invention can include the electronic circuit described above.

An electronic apparatus of the invention can include the electro-optical device described above.

The term "corresponding" does not only mean that the current level of the programming current or the data current is equal to the current level of the reproducing current or the driving current. What the current level of the reproducing current or the driving current determines may be taken into account in addition to the current level of the programming current or the data current. Capacitance coupling involved with a capacitor coupled to a gate of a driving transistor is an example for a factor determining the gate voltage of the driving transistor in addition to the data signal such as the programming current.

An electronic circuit as shown in FIG. 1, which is to be hereinafter described, has a capacitor C1 disposed between a gate of a driving transistor T2 and one of a source and a drain of the driving transistor T2. The voltage of the gate of the driving transistor T2 may be affected by the potential of a node N between an organic electroluminescent element OEL as a driven element and a driving transistor T2 even during a reproduction step because of a capacitance coupling involved with the capacitor C1.

BRIEF DESCRIPTION OF THE DRAWINGS

The invention will be described with reference to the accompanying drawings, wherein like numerals reference like elements, and wherein.

DETAILED DESCRIPTION OF EMBODIMENTS

Electronic circuits related to the invention are applicable to various electronic device. Electro-optical device, such as electroluminescent (EL) device, liquid crystal device, and electrophoretic device and detecting device for microanalysis or sensing are examples to which the electronic circuits are applicable. Below, several circuits that are applicable to organic electroluminescent device will be described as preferred examples. It should also be understood that the electronic circuits are also applicable to silicon based transistor circuits, polysilicon thin film transistors (TFTs), and amorphous silicon TFTs.

Figure 1:
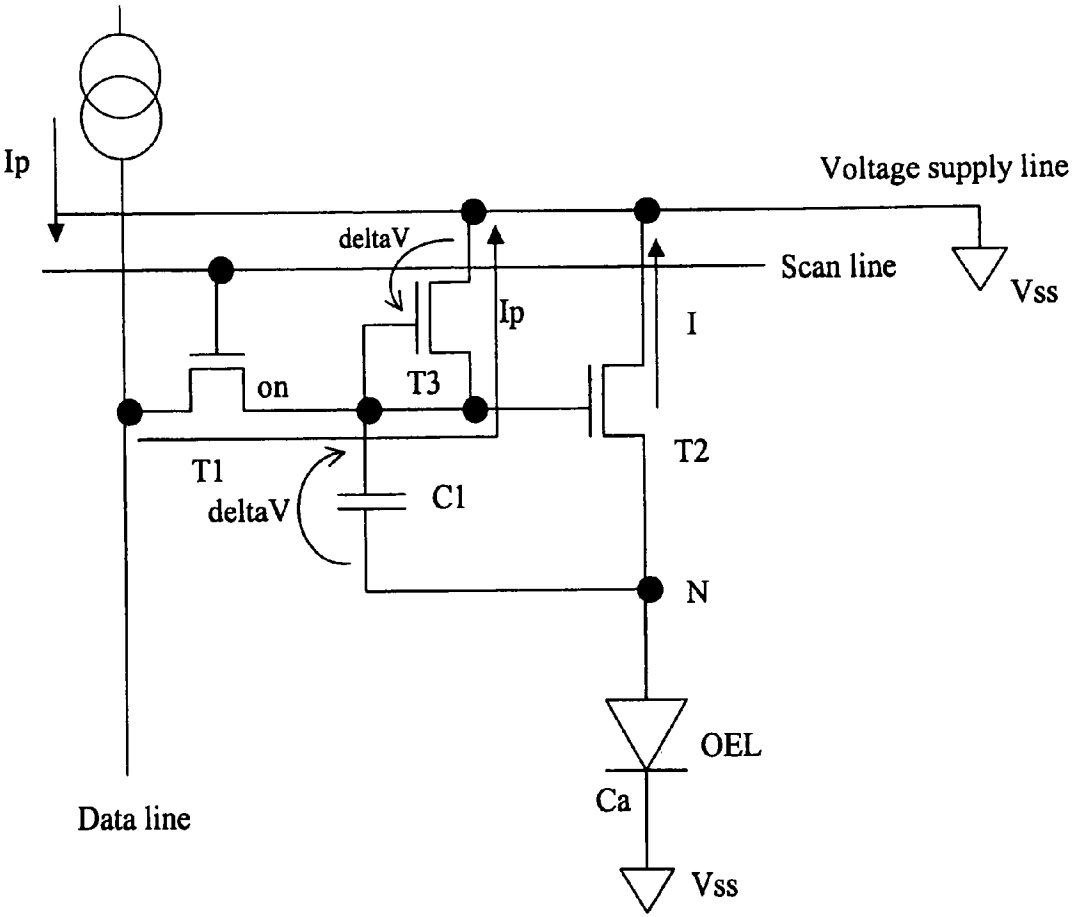
FIG. 1 shows a pixel circuit of a first embodiment and an operation during a programming stage.

FIG. 1 shows a pixel circuit related to a first embodiment of the invention. As shown, the pixel circuit can include three transistors T1, T2, and T3, a capacitor C1, and an organic EL element (OEL). A gate of transistor T1 is coupled to a scanning line and operates as a switching transistor. A gate of the transistor T1 can be supplied with a scanning signal from the scanning line. Transistor T1 is in an on-state when a scanning signal that makes transistor T1 on-state is supplied to the gate of transistor T1. Transistor T2 is a driving transistor whose conduction state determines a current level of a driving current supplied to OEL. Transistor T3 is a transistor for compensating characteristics of transistor T2. A gate of transistor T3 is coupled to one terminal of transistor T3, such as a source or drain of transistor T3. All of the transistors T1, T2, and T3 are of n-channel in this embodiment.

As shown, the capacitor C1 is disposed between a gate of transistor T2 and one of a source and drain of T2. One of the electrodes constituting C1 is coupled to the gate of T2 while the other is coupled to a node N between T2 and OEL. As a result of this configuration of capacitor C1, the gate voltage of transistor T2 is affected by the potential of node N. In particular, the difference between the gate voltage and source voltage of transistor T2 can be held constant during both a programming and reproduction step, described in greater detail below.

In this embodiment, there are at least two steps for driving this pixel circuit. One is a programming step, during or through which a gate voltage of T2 is determined. The second is a reproducing step, during which a driving current is supplied to OEL through transistor T2.

As shown in FIG. 1, during the programming step a programming current Ip flows between a data line and a voltage supply line through transistors T1 and T3. In this embodiment, the programming current Ip flows from the data line to the voltage supply line. The potential of the voltage supply line is desired to be equal to or less than a potential of a counter electrode Ca of OEL, i.e., Vss or lower than Vss during at least a part of the programming step. The gate voltage of transistor T2 is determined according to Ip flowing between the data line and the voltage supply line through transistors T1 and T3. The potential of a terminal of transistor T2 which is on an opposite side to OEL is desired to be equal to Vss or lower than Vss during at least a portion of the programming step. In other words, the potential of the terminal of transistor T2 is set so that the direction of a current flowing through transistor T2 during the programming step is opposite to the direction of a current flowing through transistor T2 during the reproducing step. Changing the direction between the programming step and the reproducing step can suppress a shift of a threshold voltage of transistor T2 or deterioration of OEL.

Figure 2:
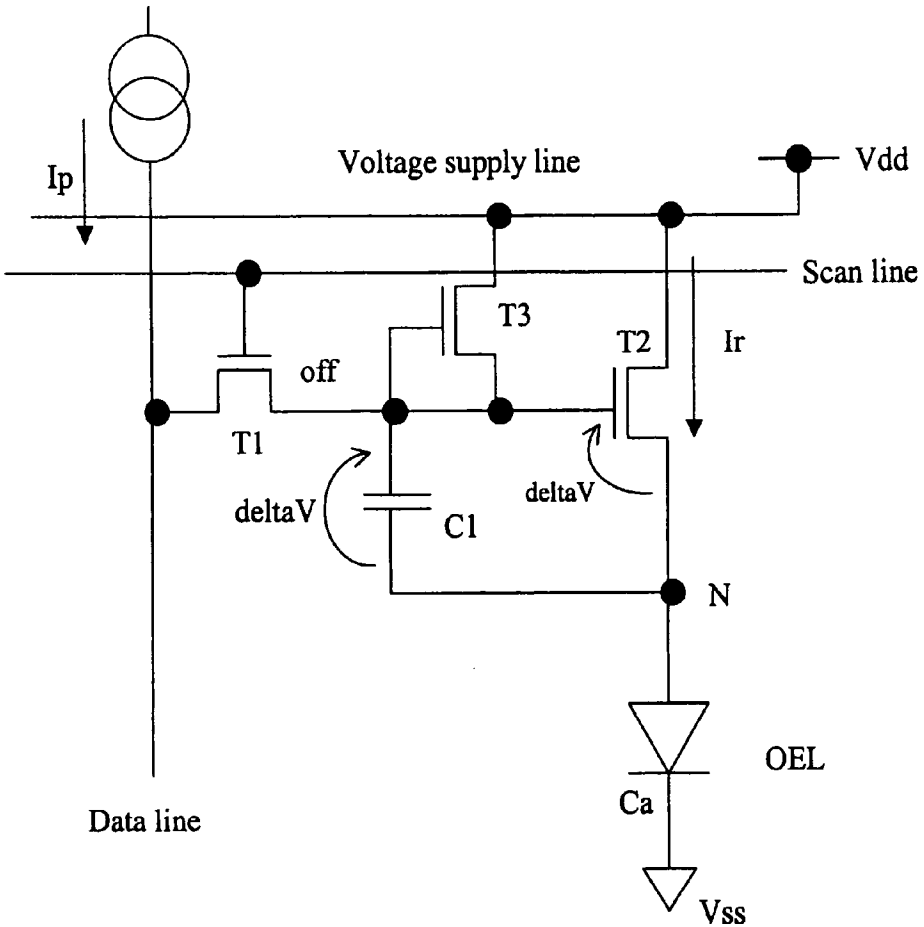
FIG. 2 shows a pixel circuit of a first embodiment and an operation during a reproducing stage.

As shown in FIG. 2, during the reproducing step, after determining the gate voltage of transistor T2 by Ip, transistor T1 is turned off so as to separate the gate of transistor T3 from the data line electrically, and the potential of the voltage supply line is changed to Vdd. In this embodiment Vdd is higher than Vss. By raising from Vss to Vdd, transistor T3 is automatically turned off so as to separate the gate of transistor T3 from the voltage supply line electrically. A driving current Ir having a current level according to the gate voltage determined by Ip flows between the voltage supply line and Ca through transistor T2. In this embodiment, Ir flows from the voltage supply line to Ca.

A potential of node N located between transistor T2 and OEL is not always constant throughout the programming step and the reproducing step, but usually depends on the current level of Ir flowing through transistor T2. Due to this, inconsistency between currents Ip and Ir often occurs. The capacitor C1 is disposed between N between and the gate of T2 so that the gate voltage can follow the change of the potential of node N. If the potential of N during the reproducing step becomes higher than the potential of node N during the programming step, the gate voltage determined by supplying the programming current can be raised through the capacitance coupling of the capacitor C1 during the reproducing step so as to reduce the degree of inconsistency between currents Ip and Ir.

Figure 3:
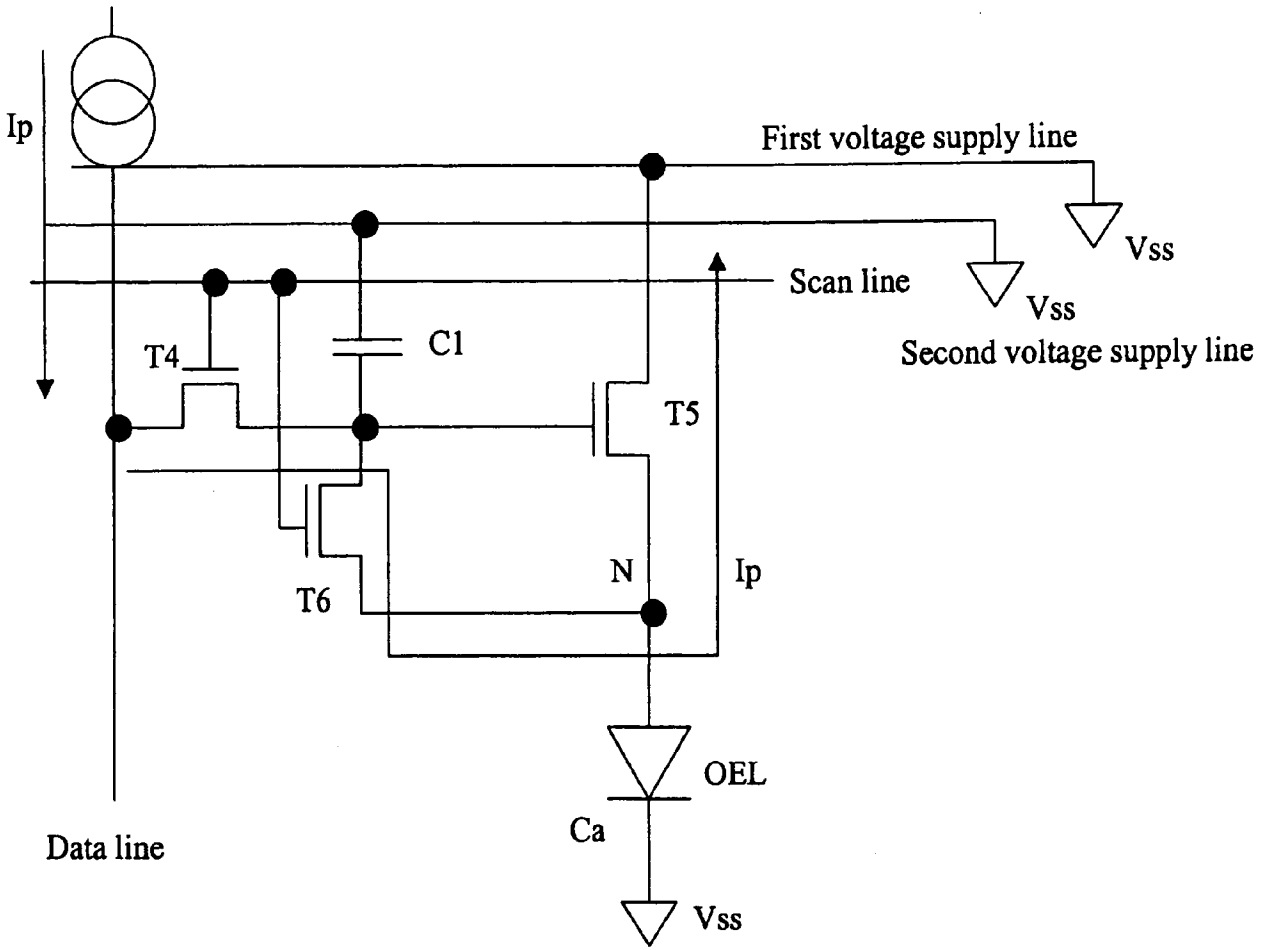
FIG. 3 shows a pixel circuit of a second embodiment and an operation during a programming stage.

FIG. 3 shows an exemplary pixel circuit related to the invention. There are three transistors T4, T5, and T6, a capacitor C1, and an organic EL element (OEL). Transistor T4 operates as a switching transistor of which a gate is supplied with a scanning signal from a scanning line. Transistor T4 becomes on-state when a scanning signal that makes transistor T4 on-state is supplied to the gate of transistor T4. Transistor T5 is a driving transistor whose a conduction state determines a current level of a driving current supplied to OEL. Transistor T6 is a transistor that controls an electrical connection between a node N and the gate of transistor T5. Node N is located between transistor T5 and OEL. Capacitor C1 is disposed between the gate of transistor T5 and a second voltage supply line. One of electrodes constituting capacitor C1 is coupled to the gate of transistor T5 while the other is coupled to the second voltage line.

There are at least two steps for driving this pixel circuit. The first is a programming step, during or through which the gate voltage of T5 is determined. The second is a reproducing step, during which the driving current is supplied to the OEL through transistor T5.

During the programming step, a programming current Ip flows between a data line and a first voltage supply line through transistors T4, T6 and T5 during the programming step. In this embodiment, the programming current Ip flows from the data line to the first voltage supply line. The potential of the first voltage supply line is desired to be equal to or less than the potential of counter electrode Ca of OEL, i.e., Vss or lower than Vss. The gate voltage of transistor T5 is determined according to the programming current Ip flowing between the data line and the first voltage supply line through transistors T4, T6 and T5. The potential of a terminal of transistor T5 which is on an opposite side to OEL is desired to be Vss or lower than Vss. In other words, the potential of the terminal of transistor T5 is set so that the direction of a current Ip flowing through the transistor T5 during the programming step is opposite to the direction of a current flowing Ir (FIG. 4) through the transistor T5 during the reproducing step. As a result of the changing the direction between the programming step and the reproducing step, threshold voltage of T5 or deterioration of OEL can be suppressed.

Figure 4:
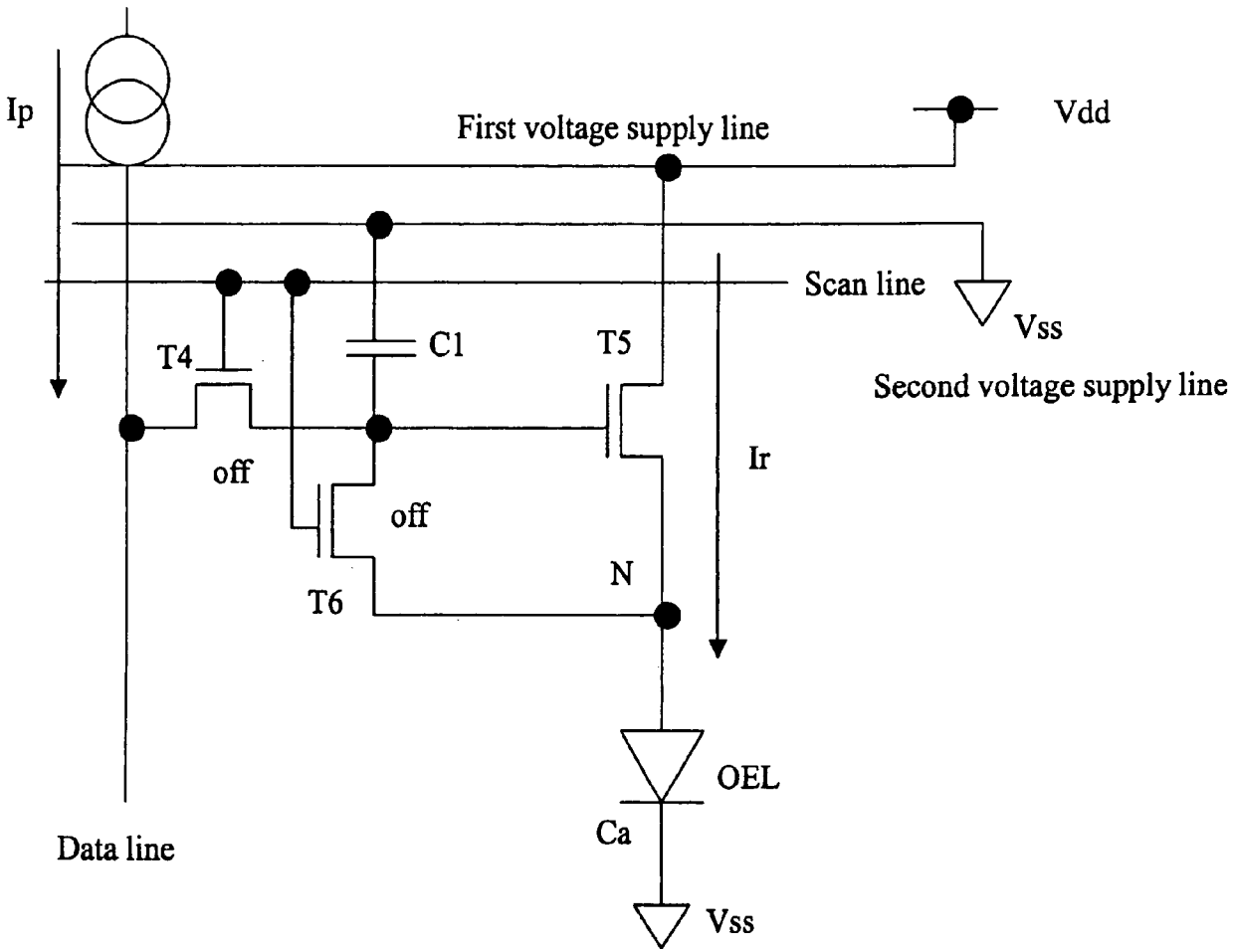
FIG. 4 shows a pixel circuit of a second embodiment and an operation during a reproducing stage.

After determining the gate voltage by the programming current Ip, during the reproducing step, transistor T4 is turned off so as to separate the gate of transistor T5 from the data line electrically, and the potential of the first voltage supply line is changed to Vdd as shown in FIG. 4. In this embodiment Vdd is higher than Vss. By raising from Vss to Vdd, a driving current Ir having a current level according to the gate voltage determined by Ip flows between the first voltage supply line and the counter electrode Ca of OEL through transistor T5. In this embodiment, the driving current Ir flows from the first voltage supply line to Ca.

A threshold voltage shift or deterioration of driving transistors T2 and T5 can be suppressed since the direction of the programming current flowing through driving transistors T2 and T5 is different from that of the driving current flowing through driving transistors T2 and T5 as mentioned above. Furthermore, effective utilization of time or one frame can be attained since a reverse biasing current can be used as the programming current as mentioned above. Accordingly, any of the electronic circuits explained above are especially suitable for an electronic circuit including an amorphous silicon transistor, which shows a significant threshold voltage shift and usually requires a certain means for suppression of the significant threshold voltage shift.

Figure 5:
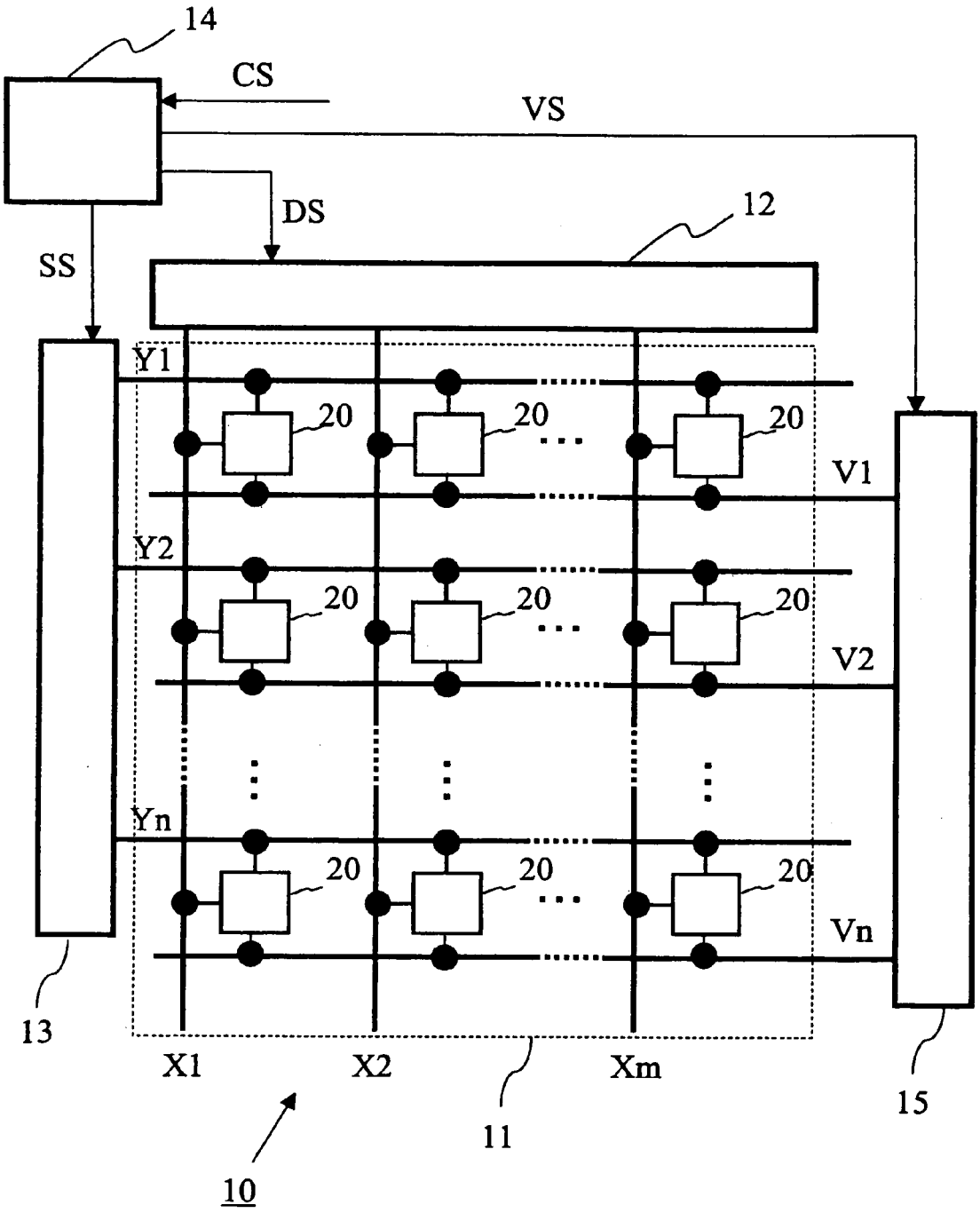
FIG. 5 shows an organic EL device to which electronic circuits of the present invention can be applicable.

Each of electronic circuits explained above can be applicable to a pixel circuit of electro-optical device. FIG. 5 shows organic EL device 10 as an example electro-optical device having pixel circuit 20 in pixel region 11. Herein any of electronic circuits explained above can be used as pixel circuit 20. Organic EL device 10 also has data-line driving circuit 12, scanning-line driving circuit 13, input control circuit 14, and voltage-supply-line control circuit 15 to drive pixel circuit 20. Pixel circuits 20 and one or two of data-line driving circuit 12, scanning-line driving circuit 13, input control circuit 14, and voltage-supply-line control circuit 15 may be implemented on one substrate. Alternatively, all of data-line driving circuit 12, scanning-line driving circuit 13, input control circuit 14, voltage-supply-line control circuit 15, and pixel circuits 20 may be implemented on one substrate. Typically, pixel circuits 20 and at least one of scanning-line circuit 13 and voltage-supply-line control circuit 15 may be implemented on one substrate. Optimally, pixel circuits 20, scanning-line circuit 13, and voltage-supply-line control circuit 15 may be implemented on one substrate.

Input control circuit 14 receives control signal CS and generates scanning-line-driving-circuit control signal SS that controls scanning-line driving circuit 13, data-line driving-circuit-control signal DS that controls data-line driving circuit 12, and voltage-supply-line-control-circuit control signal VS that controls voltage-supply-line control circuit 15. Scanning-line driving circuit 13 receives scanning-line-driving-circuit control signal SS and supplies a scanning signals to pixel circuits 20 through scanning lines Y1-Yn (n is a natural number more than 1). Data-line driving circuit 12 receives data-line driving-circuit-control signal DS and supplies programming current Ip (or data current) to pixel circuits 20 through data lines X1-Xm (m is a natural number more than 1). Data-line driving-circuit-control signal DS can include a voltage signal for generating programming current Ip. Voltage-supply-line control circuit 15 receives voltage-supply-line-control-circuit control signal VS and control the potential of each of voltage supply lines V1-Vn extending in a direction that intersects a direction in which data lines X1-Xm extend or that is substantially parallel to a direction in which scanning lines Y1-Ym extend. Typically, pixel circuits 20 may be driven by a driving method including at least two steps. The potential of each of voltage supply lines may be set according to each of the steps such that the direction of programming current Ip flowing through pixel circuits 20 is different from the direction of driving current flowing through OEL. Each of voltage supply lines V1-Vn may include first voltage supply line and second voltage supply line as shown in FIGS. 3 and 4. One of first voltage supply line and second supply line may be set to a constant voltage.

Organic EL device 10 can be used as display units of various electronic apparatuses such as computer, cellular phone, television. Organic EL device 10 also can be used as a printer head.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. An electronic device, comprising:

a plurality of data lines;

a plurality of scanning lines;

a plurality of voltage supply lines; and a plurality of circuits, each of the plurality of circuits including an electroluminescent element, a first transistor, a second transistor, and a third transistor, the first transistor having a first terminal, a second terminal, and a channel region formed between the first terminal and the second terminal, the first terminal permanently connected to a first voltage supply line of the plurality of voltage supply lines, the second transistor having a control terminal connected to a scanning line of the plurality of scanning lines for supplying a data current from a data line of the plurality of data lines to a respective pixel circuit, the third transistor having a control terminal connected to the scanning line for controlling an electrical connection between a control terminal of the first transistor and the second terminal of the first transistor, a capacitor having a third terminal permanently connected to a second voltage supply line of the plurality of voltage supply lines and a second terminal connected to the control terminal of the first transistor, the first and second voltage supply lines configured to be controlled separately, the first voltage supply line supplying a first and a second voltage level and the second voltage supply line supplying the first voltage level;

the electronic device being configured such that:

a reverse biasing current flows from the data line through the second and third transistors and through the second terminal of the first transistor to the first voltage supply line through the first terminal of the first transistor when a potential of the first voltage supply line and a potential of the second voltage supply line are constantly set to the first voltage level; and a forward biasing current flows from the first voltage supply line to the second terminal of the first transistor through the first terminal of the first transistor when a potential of the first voltage supply line is constantly set to the second voltage level and the second voltage supply line is constantly set to the first voltage level, the first voltage level being different from the second voltage level, and the forward biasing current causing the electroluminescent element to emit light.

2. An electronic device, comprising:

a plurality of data lines;

a plurality of scanning lines;

a plurality of voltage supply lines; and a plurality of circuits, each of the plurality of circuits including:

a first transistor, a second transistor, and a third transistor, the first transistor having a first terminal, a second terminal, and a channel region formed between the first terminal and the second terminal, the first terminal permanently connected to a first voltage supply line of the plurality of voltage supply lines, the second transistor having a control terminal connected to a scanning line of the plurality of scanning lines for supplying a data current from a data line of the plurality of data lines to a respective pixel circuit, the third transistor having a control terminal connected to the scanning line for controlling an electrical connection between a control terminal of the first transistor and the second terminal of the first transistor, a capacitor having a third terminal permanently connected to a second voltage supply line of the plurality of voltage supply lines and a fourth terminal connected to the control terminal of the first transistor, the first and second voltage supply lines configured to be controlled separately, the first voltage supply line supplying a first and a second voltage level and the second voltage supply line supplying the first voltage level; and a driven element;

the electronic device being configured such that:

a reverse biasing current flows from the data line through the second and third transistors and through the second terminal of the first transistor to the first voltage supply line through the first terminal of the first transistor when a potential of the first voltage supply line and a potential of the second voltage supply line are constantly set to the first voltage level; and a forward biasing current flows from the first voltage supply line to the driven element through the first transistor when a potential of the first voltage supply line is constantly set to the second voltage level and the second voltage supply line is constantly set to the first voltage level, the first voltage level being different from the second voltage level.

3. The electronic device according to claim 1, a gate voltage of the first transistor being based on the reverse biasing current.

4. The electronic device according to claim 2, a gate voltage of the first transistor being based on the reverse biasing current.

5. The electronic device according to claim 4, a current level of the forward biasing current corresponding to a voltage level of the gate voltage.

6. The electronic device according to claim 2, the driven element being an electro-optical element.

7. The electronic device according to claim 1, the electronic device being configured such that a characteristic of the first transistor is compensated.

8. The electronic device according to claim 1, a characteristic of the first transistor being compensated by a first step carried out such that the reverse biasing current flows from the first terminal to the first voltage supply line through the second terminal during at least a part of a first period.

9. The electronic device according to claim 1, wherein the third transistor is a compensating transistor that compensates for a characteristic of the first transistor.

10. The electronic device according to claim 9, the reverse biasing current flowing through the compensating transistor.

11. The electronic device according to claim 6, the electronic device being configured such that the forward biasing current flows from the first voltage supply line to a counter electrode of the electro-optical element through the first terminal and the second terminal during at least a part of a period.

12. The electronic device according to claim 1, the first voltage level being lower than the second voltage level.

13. The electronic device according to claim 2, the second terminal being located between the driven element and the first terminal.

14. The electronic device according to claim 1, the plurality of voltage supply lines intersecting the plurality of data lines.

15. The electronic device according to claim 2, the plurality of voltage supply lines intersecting the plurality of data lines.

16. An electro-optical device, comprising:

a plurality of data lines;

a plurality of scanning lines;

a plurality of voltage supply lines intersecting the plurality of data lines; and a plurality of circuits, each of the plurality of circuits including:

a first transistor, a second transistor, and a third transistor, the first transistor having a first terminal, a second terminal, and a channel region formed between the first terminal and the second terminal, the first terminal permanently connected to a first voltage supply line of the plurality of voltage supply lines, the second transistor having a control terminal connected to a scanning line of the plurality of scanning lines for supplying a data current from a data line of the plurality of data lines to a respective pixel circuit, the third transistor having a control terminal connected to the scanning line for controlling an electrical connection between a control terminal of the first transistor and the second terminal of the first transistor, a capacitor having a third terminal permanently connected to a second voltage supply line of the plurality of voltage supply lines and a fourth terminal connected to the control terminal of the first transistor, the first and second voltage supply lines configured to be controlled separately, the first voltage supply line supplying a first and a second voltage level and the second voltage supply line supplying the first voltage level; and an electro-optical element;

the electro-optical device being configured such that:

a reverse biasing current flows from the data line through the second and third transistors and through the second terminal of the first transistor to the first voltage supply line through the first terminal of the first transistor when a potential of the first voltage supply line and a potential of the second voltage supply line are constantly set to the first voltage level; and a forward biasing current flows from the first voltage supply line to the electro-optical element through the first transistor when a potential of the first voltage supply line is constantly set to the second voltage level and the second voltage supply line is constantly set to the first voltage level, the first voltage level being different from the second voltage level.

17. The electronic device according to claim 2, each of the plurality of circuits further including the second transistor having a gate that is coupled to one scanning line of the plurality of scanning line.

18. The electronic device according to claim 2, a voltage of a gate of the first transistor being able to follow a change of a potential of a node located between the first transistor and the driven element.

19. An electronic apparatus comprising the electronic device according to claim 2.

20. A control circuit that is used for driving the electronic device according to claim 2.

* * * * *